US010743737B1

(12) United States Patent
Parrott

(10) Patent No.: US 10,743,737 B1
(45) Date of Patent: Aug. 18, 2020

(54) AUTOMATIC SELF-WRINGING MICROFIBER CLEANING SPONGE ON AN EXTENDABLE HANDLE

(71) Applicant: Katrina Parrott, League City, TX (US)

(72) Inventor: Katrina Parrott, League City, TX (US)

( * ) Notice: Subject to any disclaimer, the term of this patent is extended or adjusted under 35 U.S.C. 154(b) by 0 days.

(21) Appl. No.: 15/602,102

(22) Filed: May 22, 2017

Related U.S. Application Data

(60) Provisional application No. 62/339,371, filed on May 20, 2016.

(51) Int. Cl.
*A47L 13/14* (2006.01)
*A47L 13/256* (2006.01)
*A47L 13/257* (2006.01)

(52) U.S. Cl.
CPC ..... *A47L 13/14* (2013.01); *A47L 13/256* (2013.01); *A47L 13/257* (2013.01)

(58) Field of Classification Search
CPC .... A47L 13/142; A47L 13/146; A47L 13/256; A47L 13/257
See application file for complete search history.

(56) References Cited

U.S. PATENT DOCUMENTS 3,600,740 A * 8/1971 Ogier ..... A46B 17/00 15/257.01
9,609,993 B2 * 4/2017 Li ..... A47L 13/38
2002/0104179 A1 * 8/2002 Mayne ..... A47L 13/142 15/119.2
2002/0120994 A1 * 9/2002 Hirse ..... A47L 13/146 15/119.2
2011/0209300 A1 * 9/2011 Dingert ..... A47L 13/144 15/228
2012/0255139 A1 * 10/2012 Dingert ..... A47L 13/142 15/228

* cited by examiner

*Primary Examiner* — Shay Karls
(74) *Attorney, Agent, or Firm* — Delphine James

(57) ABSTRACT

A cleaning device may include an extendable ergonomic handle having a fixed handle member and a telescoping handle member. The fixed handle member may be secured at its lower distal end to a mounting plate. The mounting plate may include two plate members connected by a hinge. A sponge may be removably connected to the mounting plate. The cleaning device may include a close and release mechanism housed within the handle members operatively connected to the hinged plate members. The close and release mechanism may be actuated to squeeze and wring out the sponge and thereafter return it to a cleaning configuration.

8 Claims, 4 Drawing Sheets

AUTOMATIC SELF-WRINGING MICROFIBER CLEANING SPONGE ON AN EXTENDABLE HANDLE

CROSS-REFERENCE TO RELATED APPLICATION

This application claims the benefit of U.S. Provisional Application Ser. No. 62/339,371, filed May 20, 2016, which application is incorporated herein by reference in its entirety.

BACKGROUND

The present invention relates generally to cleaning devices, more particularly to cleaning devices having an extendable handle and a push button self-wringing actuator.

Cleaning devices, such as sponge mops, are known in the art. One type of sponge mop is disclosed in U.S. Pat. No. 9,066,646 which discloses a butterfly style mop having a wringing mechanism that wrings water from a sponge by folding it in half. The butterfly style mop includes a lever attached to the handle which is pulled upward to facilitate the wringing action. The lever is connected by a rod linkage to a pad support assembly. A hinged cleaning pad and sponge attached thereto is supported by the pad support assembly. Manipulation of the lever pulls the cleaning pad and sponge through a wringing frame member so that the sponge is folded and squeezed as it passes through the wringing frame member.

SUMMARY

There are a few hand-held cleaning devices with compressible sponges for floors and other surfaces. However, most require the use of two hands to wring and the designs are complex. For example, U.S. Pat. No. 4,893,369 to Johnson describes a "hand-held utensil for floor cleaning and other surface treatment purposes comprising a pad. Designed for users who prefer utensils that require them to bend down and exert effort directly at the point of cleaning rather than use of a mop from waist level. The handles on the holder parts further enable the user to exert effort for wringing the pad directly by using both hands to squeeze the handles rather than the wringing mechanism found in conventional floor mops. Similar devices are disclosed in U.S. Pat. No. 2,741,787 is a hand sponge cleaner and wringer that is used for cleaning dishes and other surfaces. The invention requires both hands to wring the sponge and the handle grasped in one hand and the other hand is used to pull the wringing chamber. The device disclosed in U.S. Pat. No. 5,922,140 permits the user to wring the device with one hand but the design may limit the maneuverability and usage capability. It is designed with a rigid handle mounted to multiple brackets, rails, springs with a movable retraction bar and flat platens that compress the sponge.

A cleaning device may include an extendable ergonomic handle having a fixed handle member and a telescoping handle member. The fixed handle member may be secured at its lower distal end to a mounting plate. The mounting plate may include two plate members connected by a hinge. A sponge may be removably connected to the mounting plate. The cleaning device may include a close and release mechanism housed within the handle members operatively connected to the hinged plate members. The close and release mechanism may be actuated to squeeze and wring out the sponge and thereafter return it to a cleaning configuration.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
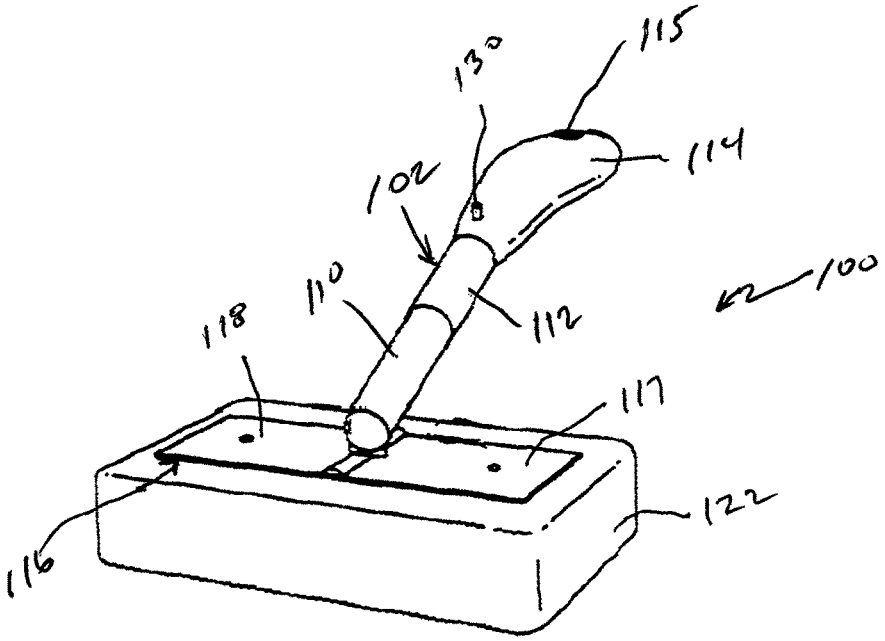
FIG. 1 is a perspective view of a cleaning device with self-wringing actuator.
Figure 2:
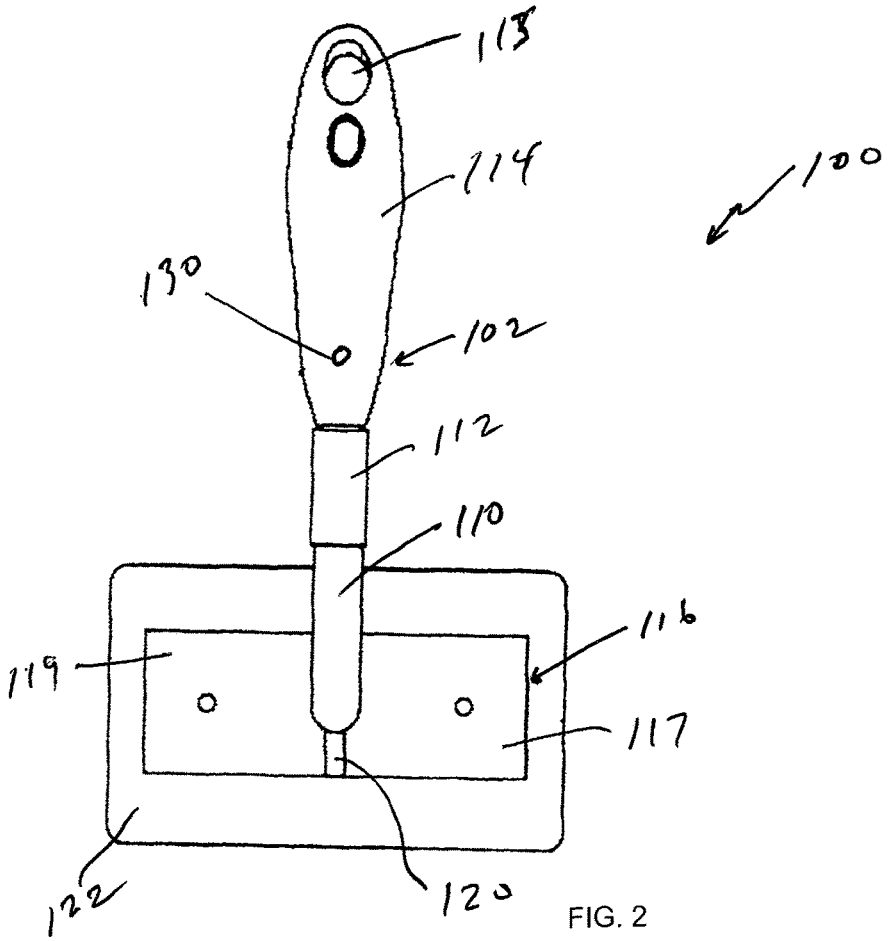
FIG. 2 is a front view of the cleaning device shown in FIG. 1.
Figures 3A, 3B, 3C, 3D, 3E:
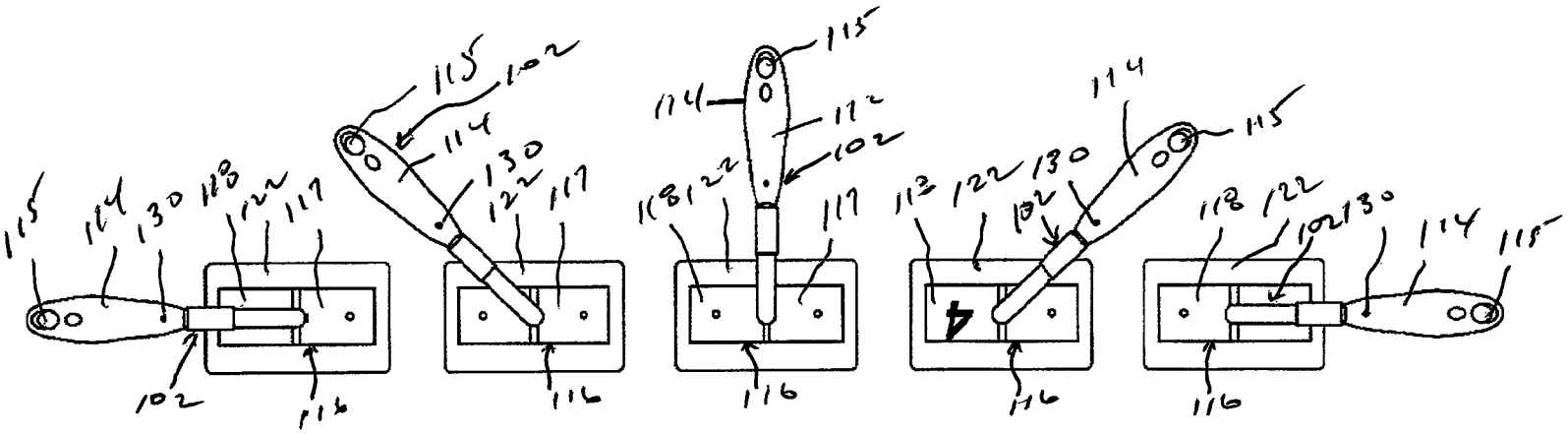
FIGS. 3A-3E are top plan views illustrating swivel positions of the handle of the cleaning device shown in FIG. 1.

Referring first to FIG. 1, a cleaning device is generally identified by reference numeral 100. The cleaning device 100 may include an extendable ergonomic handle 102 having a fixed handle member 110 and a telescoping handle member 112. A hand grip 114 may be attached to a distal end of the handle member 112. The hand grip 114 may be a separate component attached to the handle member 112 or integrally formed with the handle member 112. The hand grip 114 may include a hole 115 for convenient storage of the cleaning device 110.

The ergonomic handle 102 may preferably, but without limitation, extend from 5 to 30 inches in length with 3 to 5 inches spacing intervals so that the user may select a desired handle length. Preferably, a lever and a locking mechanism on the handle that the user may pull out or push in may be provided to adjust the length of the extendable ergonomic handle 102.

The handle member 110 may be secured to a mounting plate 116. The mounting plate 116 may include two plate members 117, 119 connected by a hinge 120, such as but without limitation, a spring back hinge. A sponge 122 may be removably connected to the mounting plate 116. The sponge 122 may, for example but without limitation, be a self-wringing microfiber sponge, microfiber cleaning sponge (preferably machine washable), microfiber antibacterial/antimicrobial technology cleaning sponge (preferably machine washable), non-abrasive/non-scratch scrub and scouring sponge, cellulose all-purpose cleaning sponge, cellulose antibacterial sponge and the like.

The cleaning device 100 may include a push button operation mode. A push button 130 may be operatively connected to a close and release mechanism housed in the handle members 110, 112, which in turn is operatively connected to the spring back hinge 120. The functionality of the cleaning device 100 is similar to a push button umbrella. Depression of the push button 130 actuates the close and release mechanism to rotate the plate members 117, 119 toward each other about the spring back hinge 120 to squeeze and wring out the sponge 122 and thereafter returning to its cleaning configuration.

Referring now to FIGS. 3A-3E, collectively, maneuverability of the handle 102 of the cleaning device 100 is illustrated. The lower distal end of the handle 102 may include a flexible neck or ball connection at the spring back hinge 120 permitting the handle 102 to be oriented at various angles relative to the mounting plate 116 to conveniently clean hard to reach areas.

Figure 4D:
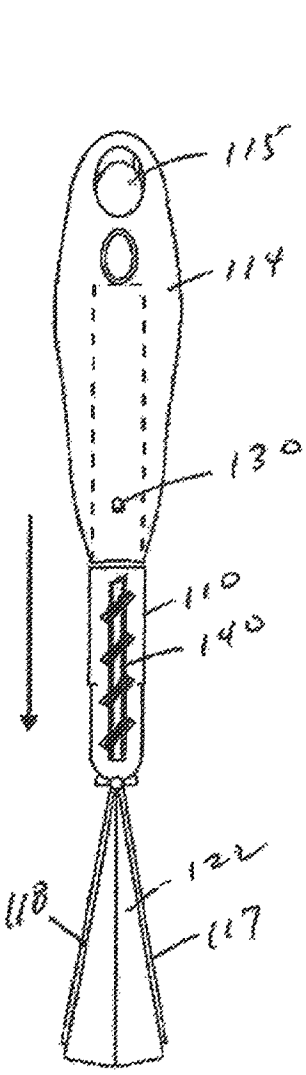
FIG. 4D is a partially broken away side view illustrating downward adjusting of the handle of the cleaning device of FIG. 4A.
Figure 4C:
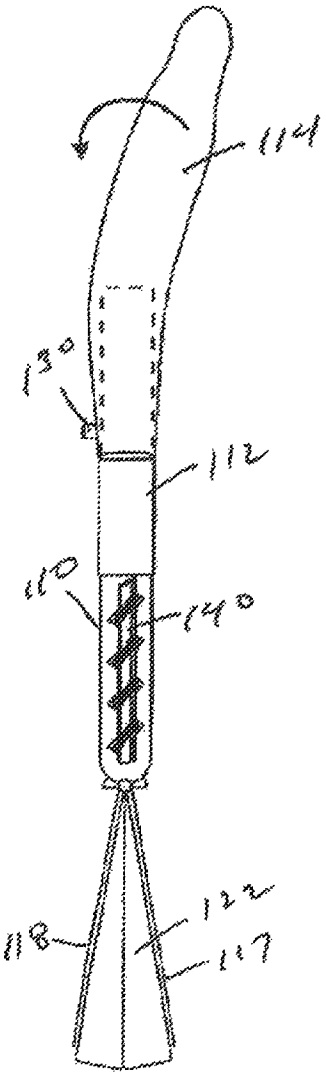
FIG. 4C is a partially broken away side view illustrating wringing the sponge by twisting the handle of the cleaning device of FIG. 4A.
Figure 4B:
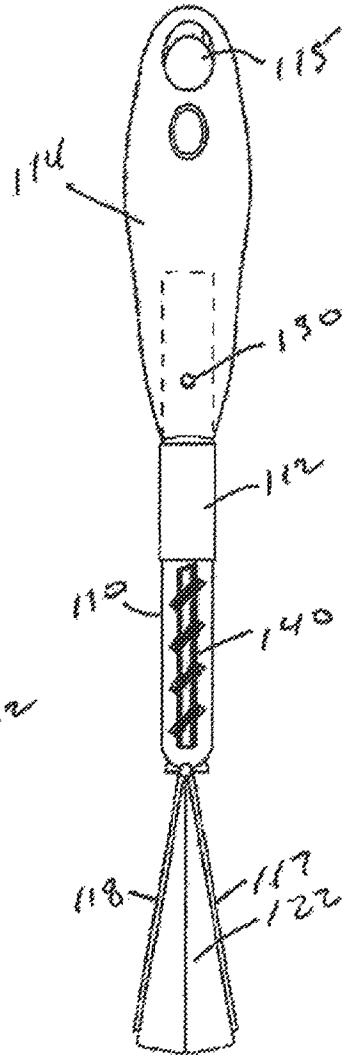
FIG. 4B is a partially broken away side view of the cleaning device shown in FIG. 4A.
Figure 4A:
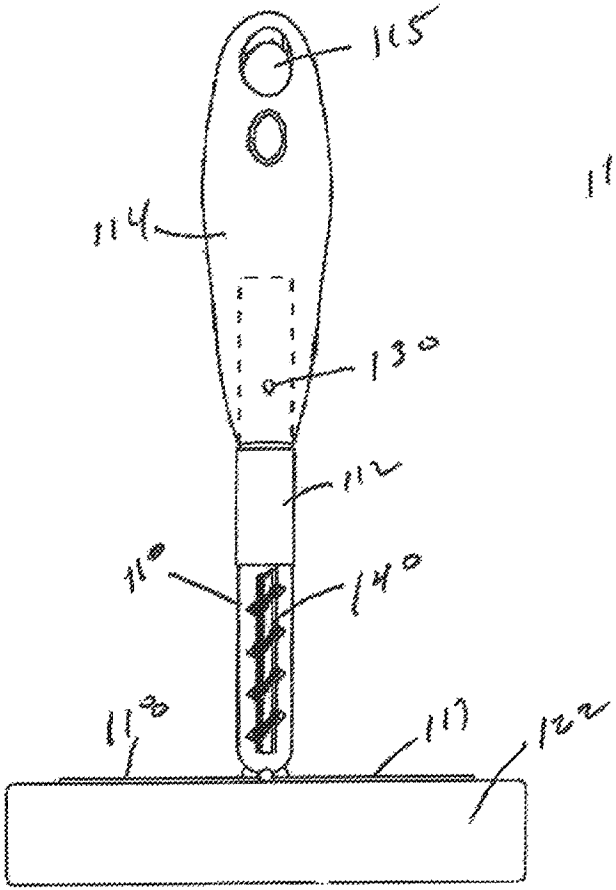
FIG. 4A is a partially broken away front view illustrating a wringing actuator of a cleaning device.

Referring now to FIGS. 4A-4D, the cleaning device 100 may include a threaded rod or bolt 140 housed in the handle member 110. The plate members 117, 118 may be actuated toward each other by twisting the handle member 112, as indicated by the arrow in FIG. 4C, to squeeze and wring out the sponge 122. The spring back hinge 120 returns the sponge 122 to its unsqueezed position upon rotating the handle member 112 back to its original position. FIG. 4D, illustrates that downward movement of the handle member 112 may force the plate members 117, 118 to squeeze and wring out the sponge 122.

The cleaning device 100 may include a retaining channel to provide a simple, economical and highly effective method for securing the sponge to the mounting plate 116. There are several ways to technically attach the self-wringing sponge to the extendable handle. In a first example but without limitation, two plastic clips may removably secure the sponge 122 to the mounting plate 116. In a second example, a plastic bar design securely locked into the extendable handle 102 at the hinge 120 may removably secure the sponge 122. In a third example, a 1 to 2-inch plate attached to the extendable handle 102 may removably secure various sponge types. A snap on with a socket (female part) and stud (male part) connection may also be provided. While removably attached, the sponge 122 may be firmly secured to the mounting plate insuring that the sponge does not shift undesirably during use. Thus, standard size sponges with different hooking or attachment mechanism may be conveniently attached and replaced as needed.

An optional dispensing chamber may be included for dispensing a user's preferred cleaning solutions. Many options are available, such as but without limitation, a chamber built into the extendable handle or a separate attachment such as a tube or container to house the preferred cleaning product.

The cleaning device 100 may be used in a conventional manner by pushing the cleaning pad 140 across a surface requiring cleaning. After a few passes the cleaning pad 140 may require wringing which a user may accomplished by pressing the push button 170 which retracts the push pin to release the slide member 152. The stretched spring 164 returns to the compressed position shown in FIG. 3B, thereby providing the force required to pull the pad support assembly upward. As the links 146 travel upward in parallel, the cleaning pad 140 may be twisted about the pivot shaft 154, illustrated in FIG. 4B, to wring and release fluid from the cleaning pad 140 Manually sliding the collar 166 downward until the push pin of the push button 170 again extends into the hole 172 of the slide member 152 resets the cleaning device 100 from the wringing mode to the cleaning mode.

Figure 5A:
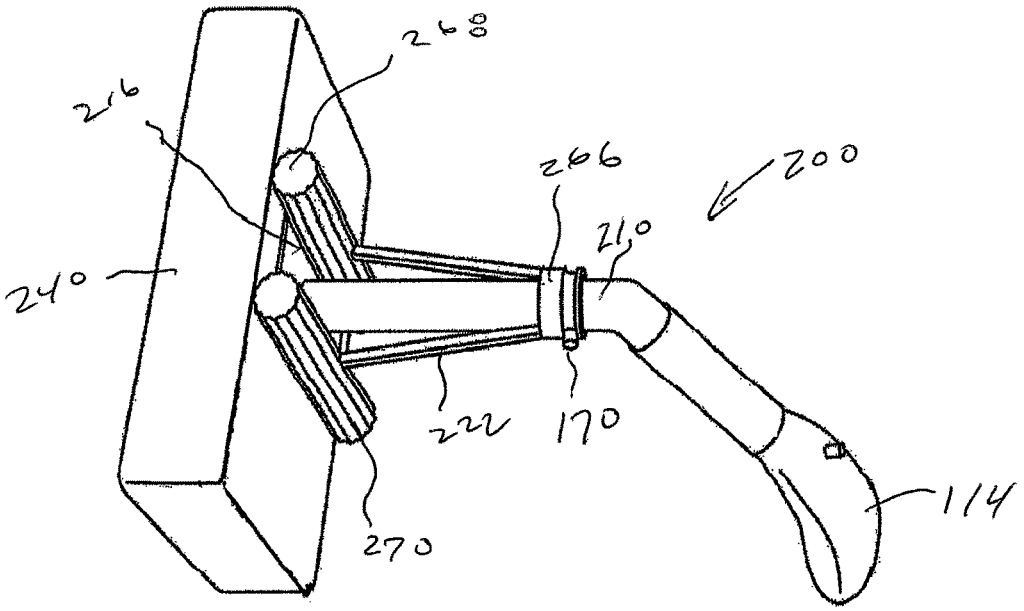
FIG. 5A is a perspective view of an alternate embodiment of a cleaning device.
Figure 5B:
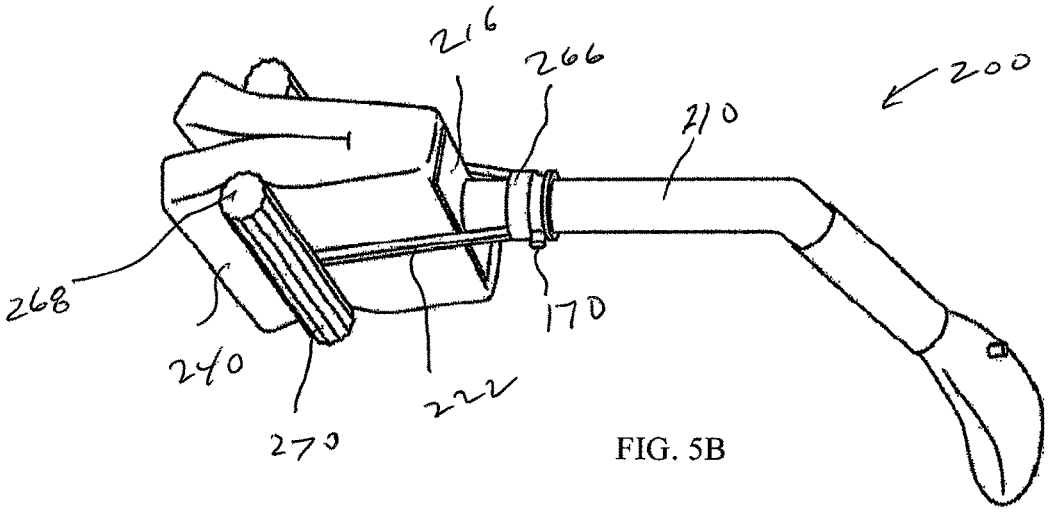
FIG. 5B is a perspective view of the cleaning device shown in FIG. 5A in a wringing mode.

Referring now to FIGS. 5A and 5B, an alternate embodiment of a cleaning device is generally identified by the reference numeral 200. The cleaning device 200 is similar to the cleaning device 100 as evidenced by the use of common reference numerals, with the exception that the cleaning device 200 is manually operable. A push pin 170 of the cleaning device 200 may extend through a collar 266 slidably mounted about the handle member 210 to lock the cleaning device 200 in the cleaning mode. The cleaning pad 240 may be fixed to a plate 216 mounted on the lower distal end of the handle member 210 in a transverse orientation. Prongs 222 may extend downward from the collar 266. Wringing members 268, such as but without limitation, rods and the like, may be fixed to the lower ends of the prongs 222. Manually sliding the collar 266 downward forces the cleaning pad 240 to be folded and squeezed between the wringing members 268. The wringing members 268 may be provided with ribs or ridges 270 to enhance the wringing action of the cleaning device 200.

In summary, the cleaning device disclosed and claimed herein offers an automatic push button on an extendable ergonomic handle to wring out a sponge. There is preferably a button on the handle that a user may pushes once or holds down to wring out the sponge. In the automatic push button embodiment, the closing and release mechanism is preferably operatively connected to the spring back hinge. In another exemplary embodiment, the cleaning device may capture stored energy to assist with springing the sponge back to its original cleaning position after the water is squeezed out. The functionality may be similar to a push button on an umbrella. Instead of the button being used to open the umbrella, it may be designed to squeeze the sponge. After the sponge is squeezed, it returns back to its original cleaning position and the user may continue to perform their normal cleaning functions.

While several embodiments of the invention have been shown and described, other and further embodiments of the invention may be devised without departing from the basic scope thereof, and the scope thereof is determined by the claims which follow.

The invention claimed is:

1. A cleaning device, comprising:

a) a handle including a first handle member in telescoping relationship with a second handle member;

b) a substantially planar mounting plate fixed to a lower distal end of said second handle member;

c) a ball joint operationally connected to the lower distal end of said second handle member wherein the handle can be oriented at various angles relative to the mounting plate;

d) said mounting plate including first and second plate members hinged together transverse to said second handle member;

e) a cleaning pad detachably secured to said mounting plate;

f) a spring back hinged connection between first and second plate members; and g) a manually activated close and release mechanism housed within the handle and is operationally connected to the spring back hinged connection which causes the first and second plate members to rotate towards each other.

2. The cleaning device of claim 1 wherein the close and release mechanism is operatively connected to a push button wherein when manually activated the first and second plate members retaining mechanism is released and the first and second plate members automatically rotates towards each other and then springs back into position.

3. The cleaning device of claim 1 wherein rotational movement of the first handle member relative to the second handle member actuates the spring back hinged connection thereby causing the first and second plate member to rotate towards each other.

4. The cleaning device of claim 3 wherein the close and release further comprises a rotationally mounted bolt member housed within the handle that is operationally connected to the spring back hinged connection.

5. The cleaning device of claim 1 wherein telescopic movement of said first handle member relative said second handle member actuates the spring back hinged connection thereby causing the first and second plate member to rotate towards each other.

6. The cleaning device of claim 1 wherein movement of the first handle member downward relative to said second handle members manually actuates the spring back hinge connection causing the first and second plate member to rotate towards each other.

7. The cleaning device of claim 1 wherein the handle telescopically extends between 5 inches to 30 inches.

8. The cleaning device of claim 7 wherein the handle telescopically extends between 5 inches to 30 inches at 3 inches to 5 inches interval.

* * * * *